US007841114B2

(12) United States Patent
McCarthy et al.

(10) Patent No.: US 7,841,114 B2
(45) Date of Patent: Nov. 30, 2010

(54) ANGLED TOP VIEW PRINTABLE HANGING FILE TABS

(75) Inventors: Brian R. McCarthy, Anaheim Hills, CA (US); Jerry G. Hodsdon, Forestdale, MA (US)

(73) Assignee: Avery Dennison Corporation, Pasadena, CA (US)

( * ) Notice: Subject to any disclaimer, the term of this patent is extended or adjusted under 35 U.S.C. 154(b) by 962 days.

(21) Appl. No.: 11/188,099

(22) Filed: Jul. 21, 2005

(65) Prior Publication Data

US 2006/0016112 A1 Jan. 26, 2006

Related U.S. Application Data

(60) Provisional application No. 60/591,347, filed on Jul. 26, 2004.

(51) Int. Cl.
*B65D 27/00* (2006.01)

(52) U.S. Cl. ..... 40/359; D19/99

(58) Field of Classification Search ..... 40/359, 40/641; D19/99; 229/67.2
See application file for complete search history.

(56) References Cited

U.S. PATENT DOCUMENTS 691,177 A 1/1902 Rand
957,447 A 5/1910 Suddick
1,115,216 A 10/1914 Laviolette
1,308,471 A 7/1919 Barker
1,317,265 A 9/1919 Bushnell
1,444,404 A 2/1923 Wagemaker
1,455,288 A 5/1923 Hardy
1,501,067 A 7/1924 Schaffert
1,562,487 A 11/1925 Anthony
1,601,041 A 9/1926 Rand
1,742,277 A 1/1930 Quigley
1,983,878 A 12/1934 Rand
2,151,359 A * 3/1939 Schmitz ..... 40/359

(Continued)

FOREIGN PATENT DOCUMENTS

DE 10 92 883 B 11/1960

(Continued)

OTHER PUBLICATIONS

PCT International Search Report PCT/US2005/025889 Feb. 6, 2006.

(Continued)

*Primary Examiner*—Joanne Silbermann
(74) *Attorney, Agent, or Firm*—Patent Group Law Department Avery Dennison Corporation

(57) ABSTRACT

Systems and tabs are provided for labeling a hanging folder having substantially vertical slots. The tab includes three walls. The first wall has a top edge and a flange located below the top edge that is adapted for engagement of the vertical slot on the hanging file folder such that the first wall projects above the file folder. The second wall has a top edge and a flange located below the top edge that is adapted for engagement of the vertical slot on the hanging file folder such that the second wall projects above the file folder. The third wall is located between the first and second walls, and located along a plane that forms an angle with either the first or second walls that is not 90 degrees.

13 Claims, 6 Drawing Sheets

U.S. PATENT DOCUMENTS

| | | | |
|---|---|---|---|
| 2,600,825 | A | 6/1952 | Aigner |
| 3,054,202 | A | 9/1962 | Scholfield |
| 3,263,688 | A | 8/1966 | Anders |
| 3,507,063 | A | 4/1970 | Jochhetrn |
| 3,839,118 | A | 10/1974 | Sparks |
| 3,924,744 | A | 12/1975 | Heimann |
| 3,937,493 | A | 2/1976 | Fasbender |
| 4,053,057 | A | 10/1977 | Snowden |
| 4,079,533 | A | 3/1978 | Rohner |
| 4,137,658 | A | 2/1979 | Wos |
| 4,204,639 | A | 5/1980 | Barber et al. |
| 4,446,183 | A | 5/1984 | Savagian |
| 4,637,149 | A | 1/1987 | Rivkin |
| 4,722,626 | A | 2/1988 | Abildgaard |
| 4,905,393 | A | 3/1990 | Laurie |
| 4,958,728 | A | 9/1990 | Effendi |
| 4,962,603 | A | 10/1990 | Kao et al. |
| 5,135,261 | A | 8/1992 | Cusack et al. |
| D331,598 | S | 12/1992 | Martin |
| 5,187,888 | A | 2/1993 | O'Brien et al. |
| 5,340,427 | A | 8/1994 | Cusack et al. |
| 5,407,234 | A | 4/1995 | Rettker et al. |
| 5,441,182 | A | 8/1995 | Sullivan |
| 5,455,410 | A | 10/1995 | Schneider |
| 5,462,783 | A | 10/1995 | Esselmann |
| 5,468,085 | A | 11/1995 | Kline |
| 5,485,000 | A | 1/1996 | Schneider |
| 5,503,435 | A | 4/1996 | Kline |
| 5,503,487 | A | 4/1996 | Ong |
| 5,513,459 | A | 5/1996 | Schneider |
| 5,558,454 | A | 9/1996 | Owen |
| 5,639,124 | A | 6/1997 | Jung |
| 5,692,670 | A | 12/1997 | Ho |
| 5,702,802 | A | 12/1997 | Rettker et al. |
| 5,743,566 | A | 4/1998 | Hunter et al. |
| 5,792,297 | A | 8/1998 | Hunter et al. |
| 5,806,147 | A | 9/1998 | Sato |
| 5,836,710 | A | 11/1998 | Owen |
| 5,848,809 | A | 12/1998 | Petkovsek |
| 5,947,525 | A | 9/1999 | Pollman |
| 5,996,130 | A | 12/1999 | Verhines |
| 5,996,881 | A | 12/1999 | Smith |
| 6,004,062 | A | 12/1999 | Hunter et al. |
| RE36,596 | E | 3/2000 | Schneider |
| 6,037,029 | A | 3/2000 | Instance |
| D423,044 | S | 4/2000 | Burke et al. |
| D424,623 | S | 5/2000 | Villarreal et al. |
| 6,068,423 | A | 5/2000 | Owen |
| 6,071,030 | A | 6/2000 | Hunter et al. |
| 6,086,107 | A | 7/2000 | Whistler et al. |
| 6,089,777 | A | 7/2000 | Wong |
| 6,099,189 | A | 8/2000 | Owen et al. |
| 6,284,338 | B1 | 9/2001 | Bauman et al. |
| 6,328,518 | B1 | 12/2001 | Wong |
| 6,361,639 | B1 | 3/2002 | Owen et al. |
| 6,375,604 | B1 | 4/2002 | Verhines |
| 6,409,409 | B2 | 6/2002 | Bauman et al. |
| 6,511,725 | B1 | 1/2003 | Rawlings |
| 6,581,971 | B1 | 6/2003 | MacWilliams |
| D478,124 | S | 8/2003 | Yamamoto et al. |
| 6,969,092 | B2 | 3/2004 | McWilliams et al. |
| 6,764,101 | B2 | 7/2004 | MacWilliams et al. |
| 7,225,992 | B2 | 8/2004 | Forster |
| 6,803,084 | B1 | 10/2004 | Do et al. |
| 6,883,423 | B2 | 4/2005 | Yamamoto et al. |
| 7,140,136 | B2 | 9/2005 | Flynn et al. |
| 7,025,382 | B2 | 10/2005 | Wiggins |
| D526,356 | S | 8/2006 | Shinya |
| D554,190 | S | 10/2007 | McCarthy et al. |
| 7,305,784 | B2 | 12/2007 | Black |
| D561,837 | S | 2/2008 | McCarthy et al. |
| 2002/0129526 | A1 | 9/2002 | Sato et al. |
| 2003/0126779 | A1 | 7/2003 | Sato et al. |
| 2004/0051296 | A1 | 3/2004 | MacWilliams et al. |
| 2005/0193608 | A1 | 9/2005 | Flynn et al. |
| 2005/0196572 | A1 | 9/2005 | Flynn et al. |
| 2005/0257408 | A1 | 11/2005 | Black |
| 2006/0016112 | A1 | 1/2006 | McCarthy et al. |
| 2007/0119082 | A1 | 5/2007 | Gilchrist |

FOREIGN PATENT DOCUMENTS

| | | |
|---|---|---|
| EP | 0153394 | 9/1985 |
| WO | WO 8500781 | 2/1985 |

OTHER PUBLICATIONS

Viewables® Color Labeling System [online]. SMEAD [retrieved on Jul. 21, 2005]. Retrieved from Internet: <URL: www.smead.com>.

International Preliminary Report on Patentability dated Jan. 30, 2007 from corresponding International Application No. PCT/US2005/025889.

* cited by examiner

ANGLED TOP VIEW PRINTABLE HANGING FILE TABS

CROSS-REFERENCES TO RELATED APPLICATIONS

This application claims the benefit of U.S. Provisional Application No. 60/591,347, filed Jul. 26, 2004.

TECHNICAL FIELD

The present invention generally relates to tabs for hanging files and, more particularly, to angled top view printable hanging file tabs for use in office filing or other applications.

BACKGROUND

File tabs are used in a wide range of filing applications where it may be desirable to identify the contents of a hanging file that is stored in a file cabinet or similar container. Identifying information may be handwritten or printed onto the tab. In many cases, the tabs are used with standard hanging files that have pre-cut vertical slots formed along an interior or exterior edge thereof. The tabs are easily attached and detached from the hanging file so that they may be replaced if and when the file contents change.

One type of identification system uses a transparent, preformed clear plastic tab that holds an insert, such as paper or lightweight board. A textual and/or graphic message may be typed, handwritten, or printed on the insert using, for example, a laser printer or an ink jet printer. The insert may then be inserted into the plastic tab, such that the message is visible through a portion of the tab. A flange extending from the tab is inserted into the vertical slot of the hanging file to secure the tab thereto. Although the message is clearly viewable when the user is at eye-level with the tab and the plastic tab protects the message from damage, the system has some drawbacks. For example, when files are tightly packed together, the user may need to separate the files to view the printed content. Moreover, because two components are used (e.g., the tab and the insert), the system is not usable if the user only has one of the two components.

Another identification system includes a sheet of die cut adhesive labels and a plastic tab. One or more messages may be typed, handwritten, or printed onto the sheet of die cut adhesive labels. A single adhesive label may then be removed from the sheet and applied to the outside of the plastic tab. An additional clear overlay label may then be applied over the printed label. After the labels and tab are assembled, a flange extending from the tab is inserted into the vertical slot of the hanging file to secure the tab thereto. Although the message may be viewed from many angles and the additional clear overlay label protects the message, an excessive number of steps and components are needed to complete the assembly of a single tab.

Still another identification system uses a perpendicular file tab that has flanges extending therefrom that may be inserted into the vertical slots of a hanging file and a sheet of die cut adhesive labels. The tab has four folds that are positioned such that, when the tab is assembled, three readable sides are formed. Two of the outer readable sides are substantially parallel to one another, while the inner readable side that is disposed therebetween is formed perpendicular to the outer readable sides. One or more messages are typed, handwritten, or printed onto the sheet of die cut adhesive labels. After the label is printed, it is removed from the sheet and applied to the readable sides. In this regard, the user can view the sides from the top, front, or back of the file. However, in instances in which the hanging files are stored in an area that is elevated above the line of sight of a reader and the files are tightly packed together, the readable portions may not be visible. Thus, the files may need to be separated from one another or the reader may need to be elevated above the files to view the readable portions of the tab. Additionally, some users may find the action of folding along four fold lines to be difficult. Moreover, an excessive number of components are needed to complete the assembly of a single tab.

Hence, there is a need for a system for identifying hanging files that addresses at least the above-noted drawbacks. Namely, there is a need for a system that is inexpensive and simple to manufacture and use and/or that allows a user to easily identify the contents of a hanging file, and/or does not need an excessive number of steps and components to complete a tab.

BRIEF SUMMARY

Systems are provided for identifying contents of hanging files. In one embodiment, and by way of example only, the system includes a tab stock sheet for supplying a file tab for labeling a hanging file folder, the hanging file folder having at least one substantially vertical slot. The system includes a release sheet and a tab. The tab is removably adhered to the release sheet, and comprises a sheet material having at least a first fold line and a second fold line formed therein. The first and second fold lines extend across a width of the tab and separate the sheet material into a first outer portion, a second outer portion, and an inner portion disposed therebetween. The first outer portion has an area that is greater than the area of each of the second outer portion and the inner portion. Each of the first and second outer portions has an area that is greater than the area of the inner portion, a base section having a flange extending therefrom, and an edge. The inner portion is configured to receive a message thereon. When the tab is removed from the release sheet, folded along the first and the second fold lines, and the first and second outer portion base section edges are aligned with one another, the tab includes a first wall, a second wall, and a third wall. The first wall has a top edge and a flange located below the top edge, the flange adapted for engagement of the vertical slot on the hanging file folder such that the first wall projects above the file folder. The second wall has a top edge and a flange located below the top edge, the flange adapted for engagement of the vertical slot on the hanging file folder such that the second wall projects above the file folder. The third wall is located between the first and second walls and along a plane that forms an angle with either the first or second walls that that is not 90 degrees.

In another embodiment, and by way of example only, the tab stock sheet includes a release sheet and a tab. The release sheet has a first section and a second section formed therein. The tab is removably adhered to the release sheet, and comprises a sheet material having a first fold line and a second fold line formed therein. The first and the second fold lines extend across a width of the tab and divide the sheet material into a first outer portion, a second outer portion, and an inner portion disposed therebetween. The inner portion is configured to receive a message thereon. The first outer portion has an area that is greater than the area of each of the second outer portion and the inner portion. Each of the first and second outer portions has an area that is greater than the area of the inner portion and includes a base section having a flange extending therefrom and an edge. The first die cut section is configured to separate from the tab when the tab is removed from the release sheet. The second die cut section is configured to adhere to the tab when the tab is removed from the release sheet. When the tab is removed from the release sheet, folded along the first and the second fold lines, and the first and second outer portion base section edges are aligned with one another, the tab includes a first wall, a second wall, and a third wall. The first wall has a top edge and a flange located below the top edge, the flange adapted for engagement of the vertical slot on the hanging file folder such that the first wall projects above the file folder. The second wall has a top edge and a flange located below the top edge, the flange adapted for engagement of the vertical slot on the hanging file folder such that the second wall projects above the file folder. The third wall is located between the first and second walls along a plane that forms an angle with either the first or second walls that that is not 90 degrees.

In another embodiment, and by way of example only, a file tab is provided. The file tab includes three walls. The first wall has a top edge and a flange located below the top edge, the flange adapted for engagement of the vertical slot on the hanging file folder such that the first wall projects above the file folder. The second wall has a top edge and a flange located below the top edge, the flange adapted for engagement of the vertical slot on the hanging file folder such that the second wall projects above the file folder. The third wall is located between the first and second walls, the third wall located along a plane that forms an angle with either the first or second walls that that is not 90 degrees.

BRIEF DESCRIPTION OF THE DRAWINGS

The present invention will hereinafter be described in conjunction with the following drawing figures, wherein like numerals denote like elements.

DETAILED DESCRIPTION OF PREFERRED EMBODIMENTS

The following detailed description of the invention is merely exemplary in nature and is not intended to limit the invention or the application and uses of the invention. Furthermore, there is no intention to be bound by any theory presented in the preceding background or the following detailed description.

Figure 1:
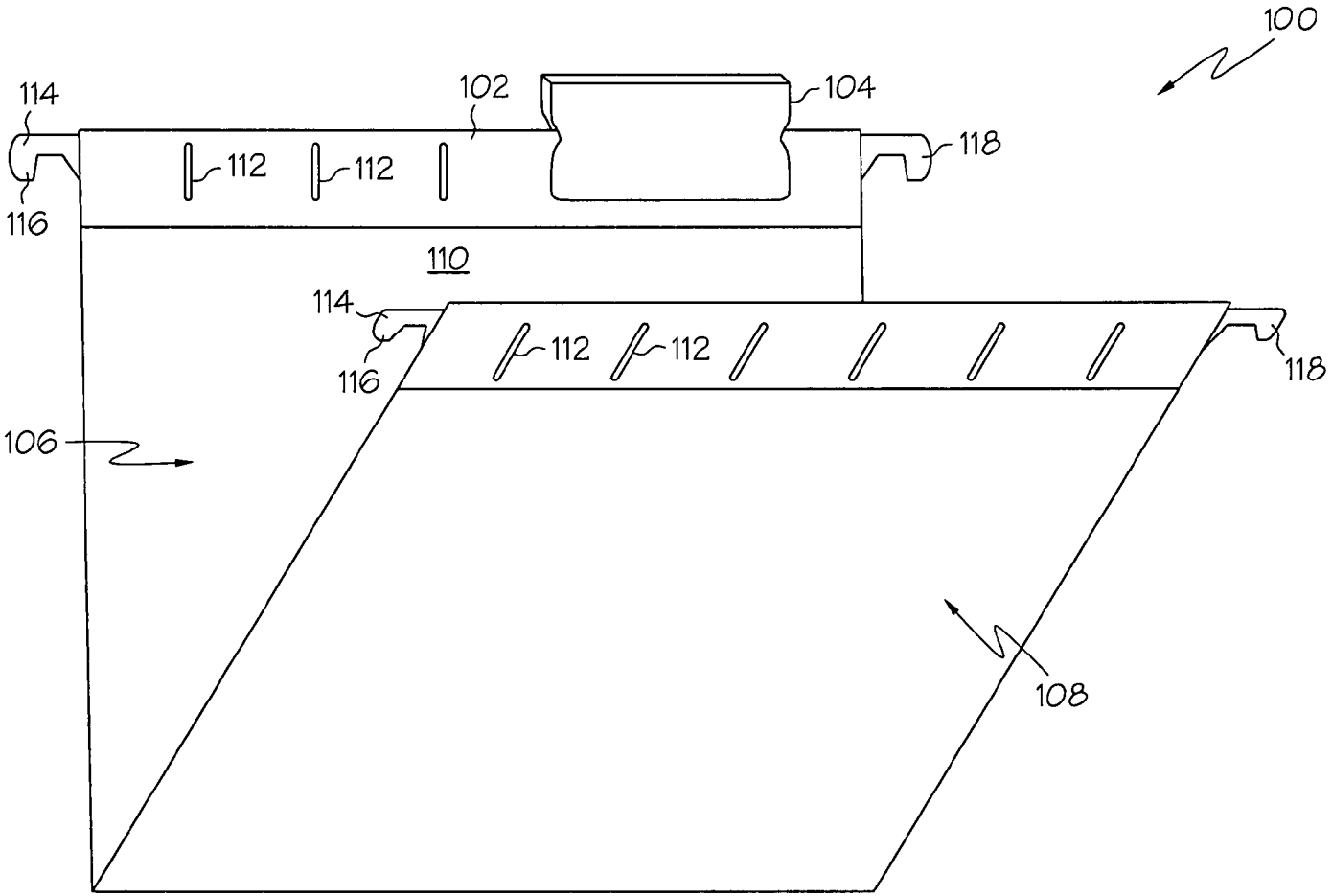
FIG. 1 is a perspective view of an exemplary system for identifying hanging files.

Turning now to the description, and with reference first to FIG. 1, a hanging file identification system 100 is depicted. The hanging file identification system 100 includes a folder 102 and a tab 104 detachably coupled to the hanging file 102. The folder 102 may be any conventional suitable folder, for example, a folded sheet having an inner containment portion 106 and an outer portion 108. The inner containment portion 106 includes a wall 110 having a plurality of slots 112 formed therein that are spaced apart from each other along an outer edge of the folder 102. Preferably, the slots 112 are substantially vertical, however, in alternate embodiments, the slots 112 may be slanted or horizontal. In another embodiment, also depicted in FIG. 1, the slots 112 may alternatively or additionally be formed on the outer portion 108 of the folder 102. At least one suspension bar 114 is coupled to the folder 102 and has two ends 116, 118 that are each configured to engage with a rail (not illustrated) that may be disposed in a file drawer or other office file container. The tab 104 is inserted into at least one of the slots 112 and projects upwardly from the folder 102.

Figure 2:
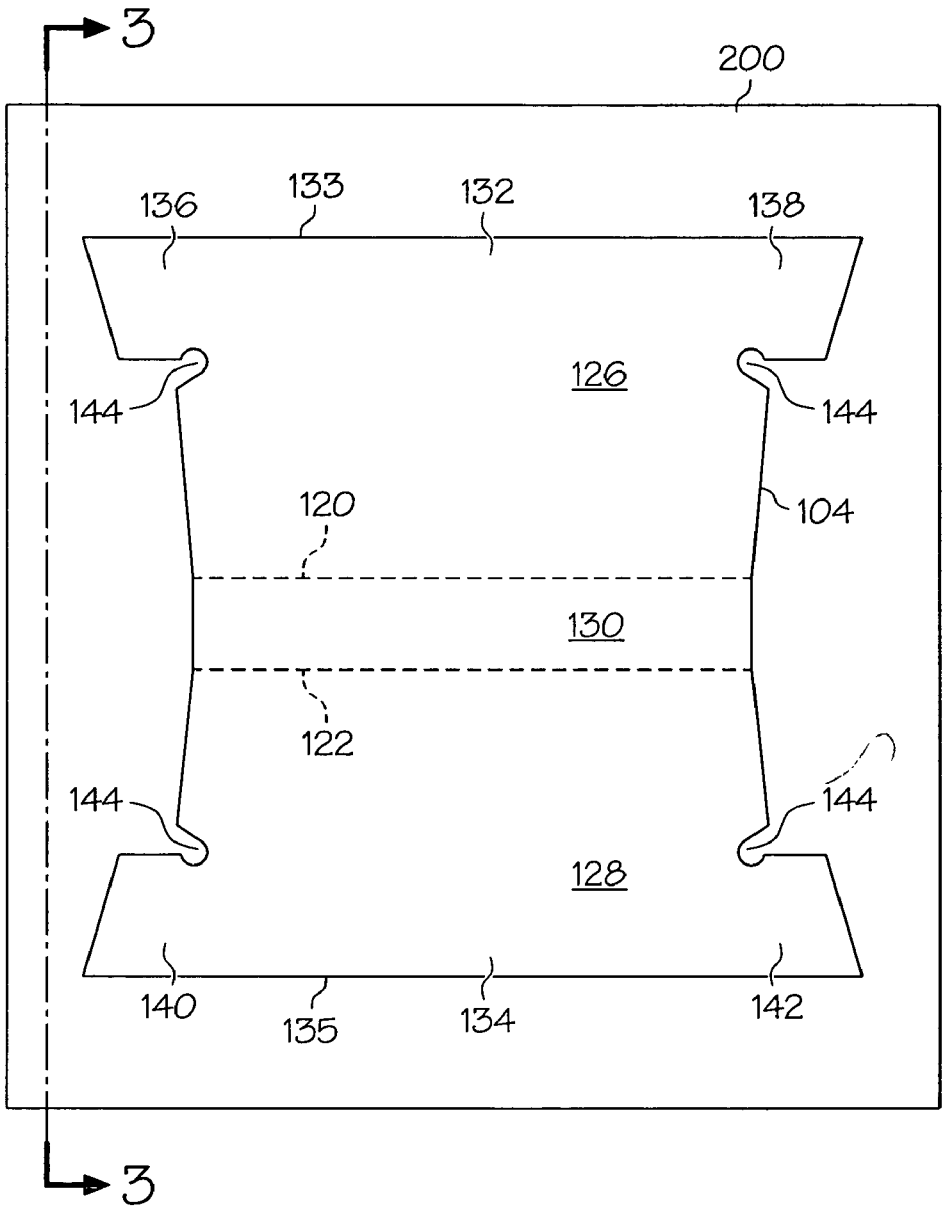
FIG. 2 is a top view of an exemplary tab stock sheet including an exemplary tab formed therein.
Figure 3:
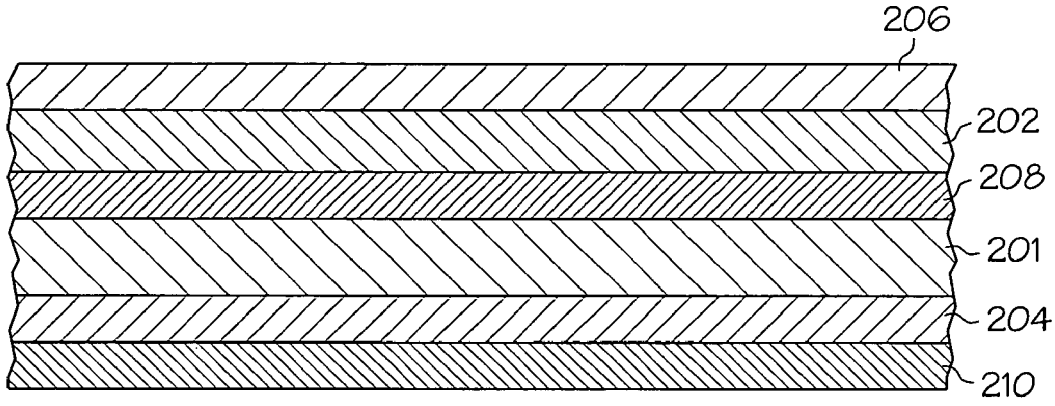
FIG. 3 is a cross section view taken along line 3-3 of the exemplary tab stock sheet depicted in FIG. 2.

With reference now to FIG. 2, the tab 104 is depicted in its unassembled state. In this embodiment, the tab 104 is part of a tab stock sheet 200. Although the tab stock sheet 200 may be constructed of any one of numerous suitable materials, it preferably includes multiple layers. In one exemplary embodiment, as shown in FIG. 3, the tab stock sheet 200 comprises a sheet of paper 201 having a layer of polyester material 202 permanently bonded thereto via an adhesive 208. It will be appreciated that the paper 201 may be any type of paper, including, but not limited to cardstock. Preferably, however, the paper 201 is constructed of material that is sufficiently configured for disposal in a conventional printer. Disposed over the polyester material 202 is an ink-receptive coating 206, such as a laser and/or ink jet receptive coating. On an opposite side of the paper 201, a second adhesive 204 is disposed thereover to allow the paper 201 to adhere a silicone-coated release sheet 210.

Returning to FIG. 2, preferably, the tab 104 is die cut into the tab stock sheet 200. It will be appreciated that a plurality of tabs 104 may be die cut or otherwise formed in an array along a least a portion of the tab stock sheet 200. Alternatively, the tab stock sheet 200 may include a single tab 104 formed therein. In one exemplary embodiment, the tabs 104 are aligned end to end. In another exemplary embodiment, the tabs 104 are spaced apart from one another.

Each tab 104 includes a first horizontal fold line 120 and a second horizontal fold line 122 that extend across the width of the tab 104. The horizontal fold lines 120, 122 may be preformed creases, scoring, or perforations formed in the tab 104, and are preferably formed substantially parallel to each other to divide the tab 104 into three portions. The three portions include a first outer portion 126, a second outer portion 128, and an inner portion 130 that is interposed therebetween. Preferably, the horizontal fold lines 120, 122 are formed such that the first outer portion 126 has an area that is greater than the areas of each of the second outer portion 128 and the inner portion 130. In a more preferred embodiment, the first and second outer portions 126, 128 each have areas that are greater than the area of the inner portion 130.

No matter the particular configuration, at least one of the two outer portions, for example, first outer portion 126, includes a base section 132. The base section 132 includes flanges 136, 138 that extend away from the tab 104 and an edge 133. At least one of the flanges 136, 138 is configured to be inserted into one of the vertical slots 112 of the folder 102. In a case in which both the second outer portion 128 also includes a base section 134, flanges 140, 142, and edge 135, both of the base sections 132, 134 are preferably mirror-images of one another. Thus, when the flanges 136, 138 and edge 133 of the first base section 132 are aligned with the flanges 140, 142 and edge 135 of the second base section 134, each of the flanges 136, 138, 140, 142 become insertable into the slots 112 of the folder 102. Grooves 144 may be formed between one or more of the flanges 136, 138 and the first base section 132 and the flanges 140, 142 and the second base section 134 to further secure the tab 104 within the slots 112.

It will be appreciated that the tab stock sheet 200 is configured such that a message may be handwritten, typed, or printed directly on the tab 104. For example, in one embodiment, the tab stock sheet 200 is fed through a conventional printer, and a message is printed onto the tab 104 while it is still disposed on the tab stock sheet 200. After the message is printed, the tab 104 is then separated from the release sheet 210 and assembled. It will further be appreciated that any one or more of the tab portions 126, 128, 130 may be used for receiving the message. Preferably, however, at least the inner portion 130 is configured to be imprinted with the message, which, as described in further detail below, allows a user to more easily view the message.

Figure 4:
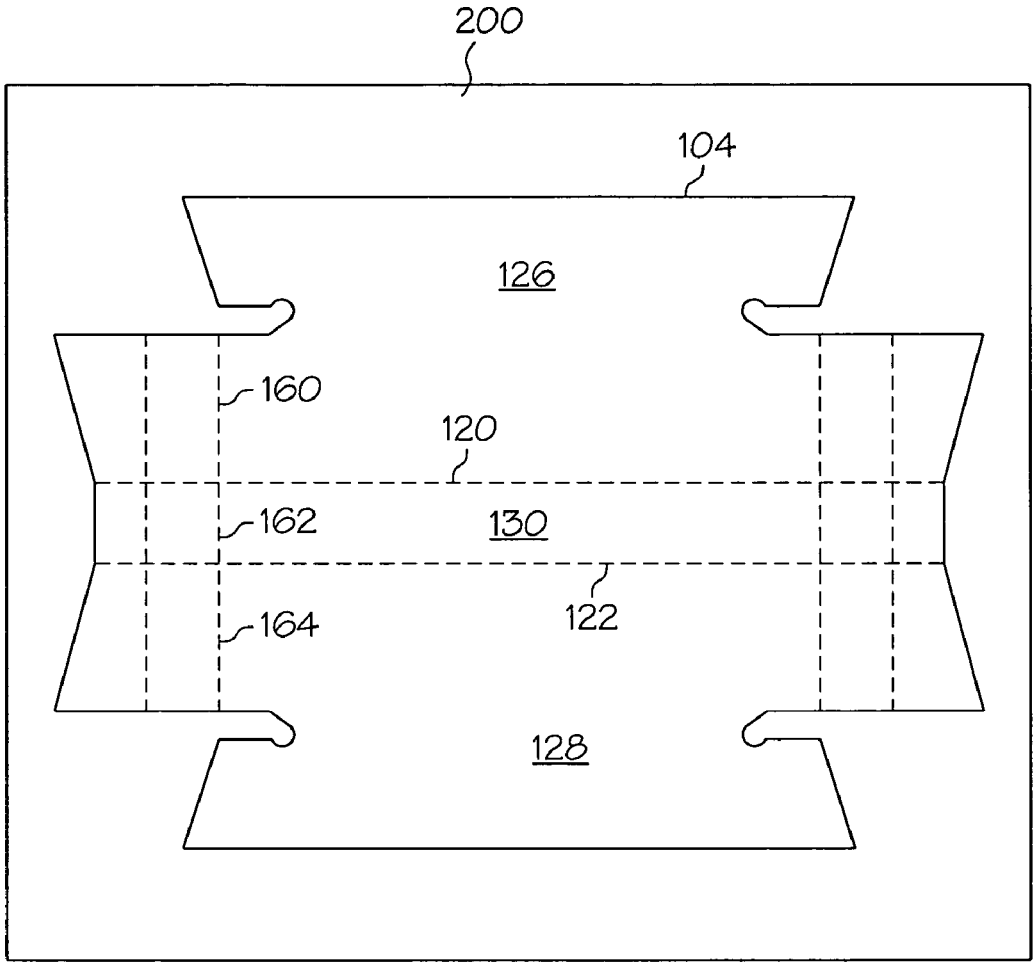
FIG. 4 is a top view of still another exemplary tab stock sheet including still another exemplary tab formed therein.

In another exemplary embodiment, as depicted in FIG. 4, the tab 104 includes a plurality of non-horizontal fold lines 160, 162, 164. The non-horizontal fold lines 160, 162, 164 are formed in any one or more of the tab portions 126, 128, 130 either perpendicular to or angled away from one or more of the horizontal fold lines 120, 122. The non-horizontal fold lines 160, 162, 164 are configured to allow the user to reduce the width of the tab 104. For example, the non-horizontal fold lines 160, 162, 164 may be perforated or scored to allow the user to remove a desired amount of the tab 104.

As mentioned briefly above, the tab 104 is assembled by first removing the tab 104 from the release sheet 210 to expose its non-exposed face. Also briefly mentioned previously, at least a portion of the tab 104 includes the adhesive layer 204 so that when the first base section 132 and the second base section 134 are aligned with one another and pressure is applied thereto, the first and second base sections 132, 134 adhere to each other. In this regard, the release sheet 210 may be die cut into two release sections. The first release sheet section is configured to separate from the tab 104 and expose the adhesive layer 204 when the tab 104 and release sheet 210 are released from each other, while the second release sheet section remains on the tab 104 to allow the user to properly align the base sections 132, 134 before adhering to each other.

Figure 5:
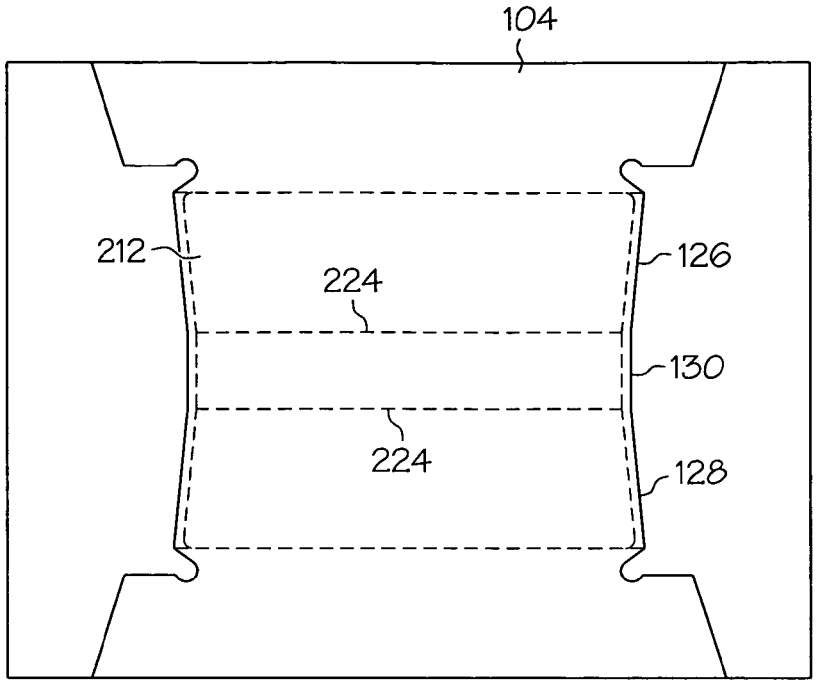
FIG. 5 is a top view of another exemplary tab stock sheet including an exemplary die cut release sheet.

An exemplary embodiment of a die cut release sheet 210 is depicted in FIG. 5. In this embodiment, two outer portions 126, 128 and the inner portion 130 each includes a release sheet segment 212 (shown in phantom) so that when the tab 104 is separated from the release sheet 210, the release sheet segment 212 remains adhered to the tab 104. Alternatively, the release sheet segment 212 includes scoring or perforations 224 therein to thereby allow a user to detach desired portions of the release sheet segment 212 from the tab 104.

Figure 6:
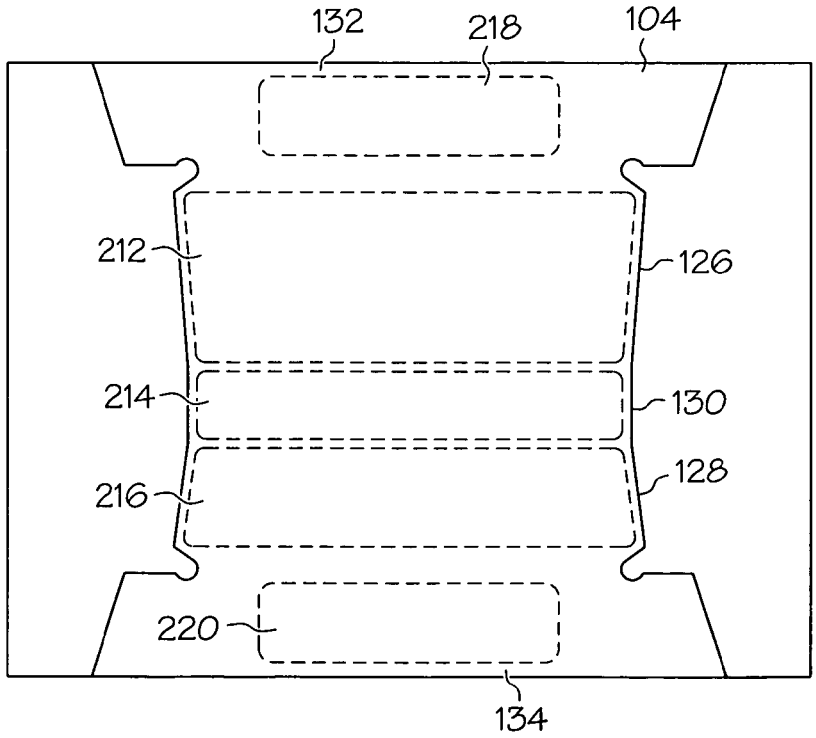
FIG. 6 is a top view still another exemplary tab stock sheet including another exemplary die cut release sheet.

In another exemplary embodiment, as shown in FIG. 6, each of the tab outer portions 126, 128 and inner portion 130 includes a segment 212, 214, 216 (shown in phantom). Preferably, the segments 212, 214, 216 are suitably aligned to prevent the outer and inner portions 126, 128, 130 from adhering to one another. In still another embodiment, also shown in FIG. 6, each base section 132, 134 additionally includes a release sheet segment 218, 220 (shown in phantom) configured to remain thereon after the tab 104 is separated from the release sheet 210. No matter the particular configuration, each of the segments 212, 214, 216 and 218, 220 is preferably die cut such that the adhesive layer 204 is exposed therearound when the tab 104 is separated from the release sheet 210.

Figure 7:
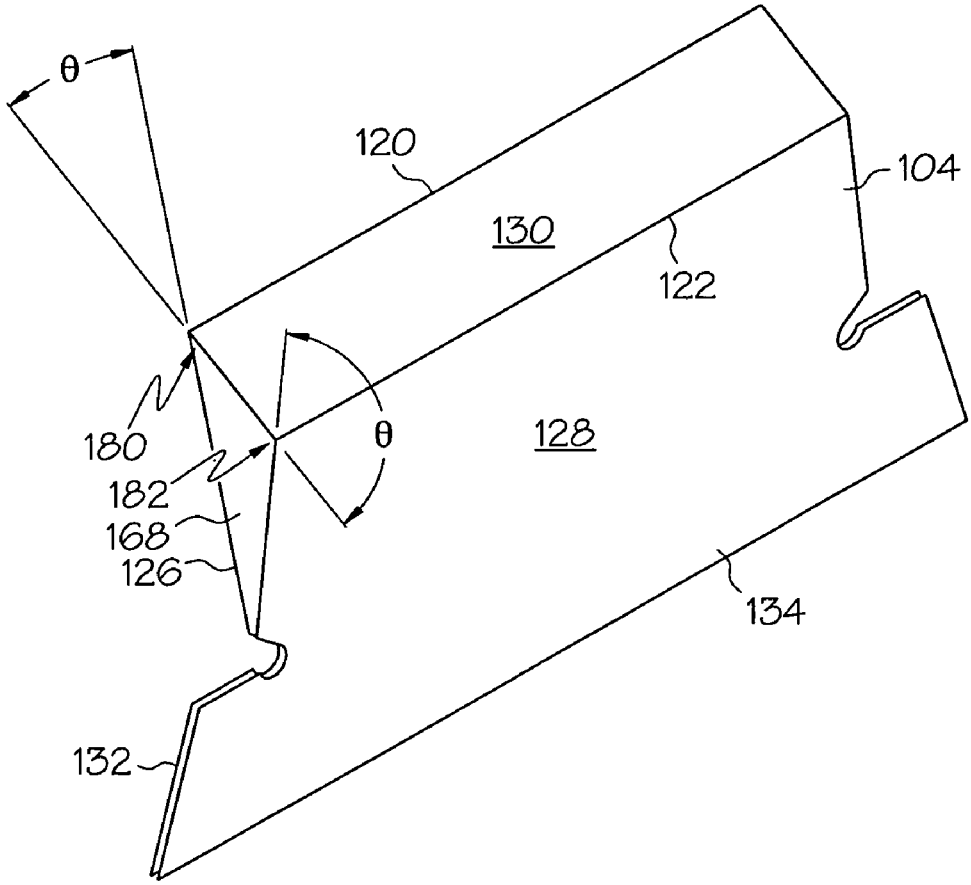
FIG. 7 is a side view of the exemplary tab depicted in FIG. 2 in its assembled state.

As shown in FIG. 7, in an embodiment in which two horizontal fold lines 120, 122 are included, an open triangle 168 is formed after the base sections 132, 134 are contacted to one another and when the tab 104 is viewed from the side. In this embodiment, because the outer portions 126, 128 are not equally sized, the inner portion 130 of the tab 104 extends therebetween at an angle. Accordingly, the inner and outer portions 126, 128, 130 of the assembled tab 104 become a first wall 126, a second wall 128, and a third wall 130, respectively. The first wall 126 has a top edge 120 and at least one flange 136, 138 located below the top edge 120 that is adapted for engagement of the hanging file folder vertical slot 112 such that the first wall 126 projects above the file folder 102. The second wall 128 has a top edge 122 and at least one flange 140, 142 located below the top edge 122 that is adapted for engagement of the hanging file folder vertical slot 112 such that the second wall 128 projects above the file folder 102. The third wall 130 is located between the first and second walls 126, 128 along a plane that forms a first angle 180 with the first wall 126 that is less than about 90 degrees and a second angle 182 with the second wall 128 that is greater than about 90 degrees. Consequently, the third wall 130 is in a plane that forms an angle with either the first or second walls 126, 128 that that is not 90 degrees. Thus, the user can view a message that may be printed thereon at an angle, and does not need to stand over the tab 104 to read the message when the folder 102 is disposed in a file cabinet (not illustrated). Additionally, if the message is printed on either of the outer portions 126, 128, the user can read the message from the front or the back of the folder 102.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A tab stock sheet for supplying a file tab for labeling a hanging file folder having at least one slot, the tab stock sheet comprising:

a release sheet; and a tab removably adhered to the release sheet, the tab comprising a sheet material having at least a first fold line and a second fold line formed therein, the first and second fold lines extending across a width of the tab and separating the sheet material into a first outer portion, a second outer portion, and an inner portion disposed therebetween, the first outer portion adjoining the inner portion, and the second outer portion adjoining the inner portion, the first outer portion having an area that is greater than an area of the second outer portion, each of the area of first outer portion and the area of the second outer portion being greater than an area of the inner portion, each of the first outer portion and the second outer portion having a base section having a flange extending therefrom and an edge, and the inner portion configured to receive a message thereon, wherein when the tab is removed from the release sheet, folded along the first and the second fold lines, and the first and second outer portion base section edges are aligned with one another, the tab assumes a three-dimensional configuration including: (i) a first wall formed from the first outer portion and having a top edge formed at the first fold line, (ii) a second wall formed from the second outer portion and having a top edge formed at the second fold line, and (iii) a third wall formed from the inner portion and located between the first and second walls, wherein the flange from the base section of the first portion is located opposite the top edge of the first wall and is adapted for engagement with at least one slot on the hanging file folder such that the first wall projects above the file folder, and the flange from the base section of the second portion is located opposite the top edge of the second wall and is adapted for engagement with at least one slot on the hanging file folder such that the second wall projects above the file folder, and the third wall is located along a plane that forms an angle with either the first or second walls that is not 90 degrees, and wherein when the tab is in its three dimensional configuration, the first, second and third walls collectively form a closed loop having an open end in the shape of a triangle.

2. The tab stock sheet of claim 1, further comprising:

a layer of paper having a first side and a second side; and a layer of polyester material bonded to the paper first side.

3. The tab stock sheet of claim 2, further comprising:

an ink-receptive coating disposed over the polyester material.

4. The tab stock sheet of claim 2, further comprising:

an adhesive layer disposed on the paper second side.

5. The tab stock sheet of claim 4, wherein the release sheet is disposed over the adhesive layer and comprises a silicone-coated release liner.

6. The tab stock sheet of claim 1, wherein the first fold line comprises a structure selected from the group consisting of a crease, a perforation, and scoring.

7. The tab stock sheet of claim 1, wherein the first and second fold lines are formed substantially parallel to each other.

8. The tab stock sheet of claim 7, wherein on any given tab the sheet material is free of other fold lines parallel to the first and second fold lines.

9. The tab stock sheet of claim 1, wherein:

the tab includes an exposed face on which the message is imprinted and a non-exposed face that is disposed on an opposite side of the tab from the exposed face; and the tab stock sheet further comprises an adhesive layer disposed over at least a portion of the non-exposed face.

10. The tab stock sheet of claim 1, wherein the tab consists of three portions consisting of the first outer portion, the second outer portion, and the inner portion.

11. The tab stock sheet of claim 1, wherein when the tab is in its three dimensional configuration, the third wall is not parallel to either the first wall or the second wall.

12. The tab stock sheet of claim 1, wherein the closed loop forms a hollow tube having a triangular cross-section.

13. The tab stock sheet of claim 1, further comprising at least one die cut in the release sheet forming at least one release sheet segment.

* * * * *